US009142886B2

(12) United States Patent
Lu et al.

(10) Patent No.: US 9,142,886 B2
(45) Date of Patent: Sep. 22, 2015

(54) STACKED ANTENNA

(71) Applicant: NATIONAL TAIWAN UNIVERSITY, Taipei (TW)

(72) Inventors: Hsin-Chia Lu, Taipei (TW); Chen-Fang Tai, Hsinchu (TW); Yi-Long Chang, Nantou County (TW)

(73) Assignee: NATIONAL TAIWAN UNIVERSITY, Taipei (TW)

( * ) Notice: Subject to any disclaimer, the term of this patent is extended or adjusted under 35 U.S.C. 154(b) by 78 days.

(21) Appl. No.: 14/217,493

(22) Filed: Mar. 18, 2014

(65) Prior Publication Data

US 2014/0197995 A1 Jul. 17, 2014

Related U.S. Application Data

(62) Division of application No. 13/015,598, filed on Jan. 28, 2011, now Pat. No. 8,717,246.

(30) Foreign Application Priority Data

Apr. 6, 2010 (TW) ..... 99110599 A

(51) Int. Cl.

| | |
|---|---|
| ***H01Q 9/28*** | (2006.01) |
| ***H01Q 1/38*** | (2006.01) |
| ***H01Q 9/04*** | (2006.01) |
| ***H01Q 19/30*** | (2006.01) |

(52) U.S. Cl.

CPC ..... *H01Q 1/38* (2013.01); *H01Q 9/0414* (2013.01); *H01Q 19/30* (2013.01)

(58) Field of Classification Search

CPC ..... H01Q 1/38; H01Q 19/30
USPC ..... 343/700 MS, 795, 818, 819, 833, 834
See application file for complete search history.

(56) References Cited

U.S. PATENT DOCUMENTS

| | | | | |
|---|---|---|---|---|
| 5,376,942 | A | 12/1994 | Shiga | |
| 6,980,172 | B2 | 12/2005 | Kwak et al. | |
| 2007/0063056 | A1 * | 3/2007 | Gaucher et al. | 235/492 |
| 2012/0263244 | A1 * | 10/2012 | Kyles et al. | 375/259 |
| 2014/0240187 | A1 * | 8/2014 | Herbsommer et al. | 343/785 |
| 2015/0070228 | A1 * | 3/2015 | Gu et al. | 343/727 |

* cited by examiner

*Primary Examiner* — Hoanganh Le
(74) *Attorney, Agent, or Firm* — CKC & Partners Co., Ltd.

(57) ABSTRACT

A stacked antenna includes a first dielectric substrate, a second dielectric substrate, at least one vertical conductive structure, at least one transmission line structure, a driven element, at least one reflector and a director. The second dielectric substrate is stacked on the first dielectric substrate. The conductive structure penetrates the first dielectric substrate or the second dielectric substrate. The transmission line structure is disposed between the first and second dielectric substrates. The driven element is disposed between the first and second dielectric substrates and is electrically connected to the conductive structure through the transmission line structure. The reflector is spaced from the driven element by the first dielectric substrate and is disposed under the first dielectric substrate. The director is spaced from the driven element by the second dielectric substrate.

6 Claims, 13 Drawing Sheets

STACKED ANTENNA

RELATED APPLICATIONS

The present application is a Divisional of U.S. application Ser. No. 13/015,598, filed on Jan. 28, 2011, and also claims the benefit of Taiwan Patent Application Serial Number 99110599, filed on Apr. 6, 2010, the disclosures of both of which are hereby incorporated by reference herein in their entirely.

BACKGROUND

1. Technical Field

The present disclosure relates to communication techniques, and more particularly, antennas.

2. Description of Related Art

Since the invention of an antenna, the wireless communication technique has experienced continued rapid growth. In a wireless communication device, this antenna is essentially a planner antenna. For the most part, patch antennas are printed on two sides of a single dielectric substrate for making the planner antenna.

With the popularization of hand-held wireless communication devices, the current trend is towards high-speed transmission and small device size. Therefore, the antenna requires a high bandwidth and a high gain. However, there are physical limits to the area and transmission speed that can be achieved in the conventional planner antennas.

In view of the foregoing, there is an urgent need in the related field to provide a way to reduce antenna size and increase an antenna gain.

SUMMARY

The following presents a simplified summary of the disclosure in order to provide a basic understanding to the reader. This summary is not an extensive overview of the disclosure and it does not identify key/critical elements of the present invention or delineate the scope of the present invention. Its sole purpose is to present some concepts disclosed herein in a simplified form as a prelude to the more detailed description that is presented later.

In one or more various aspects, the present disclosure is directed to stacked antennas, whereby the antenna size is reduced, and the antenna gain and operating bandwidth are increased.

According to one embodiment of the present invention, a stacked antenna includes a first dielectric substrate, a second dielectric substrate, at least one vertical conductive structure, at least one transmission line structure, a driven element, at least one reflector and a director.

The second dielectric substrate is stacked on the first dielectric substrate. The conductive structure penetrates the first dielectric substrate or the second dielectric substrate. The transmission line structure is disposed between the first and second dielectric substrates. The driven element is disposed between the first and second dielectric substrates and is electrically connected to the conductive structure through the transmission line structure. The reflector is spaced from the driven element by the first dielectric substrate and is disposed under the first dielectric substrate. The director is spaced from the driven element by the second dielectric substrate.

In use, the driven element can radiate a radio wave. The reflector can reflect the radio wave to adjust an antenna radiation pattern. The director can enhance a directivity of the radio wave.

According to another embodiment of the present invention, a stacked antenna includes a first dielectric substrate, a second dielectric substrate, a plurality of first hold pads, a plurality of second hold pads, at least one feed structure, at least one signal ball structure, a plurality of space balls, at least one transmission line structure, a driven element, at least one reflector and a director.

The first hold pads are disposed on the first dielectric substrate. The feed structure is disposed on the first dielectric substrate. The signal ball structure is disposed on the feed structure. The second dielectric substrate has an upper surface and a lower surface, where the lower surface faces the first hold pads and the feed structure. The second hold pads are disposed on the lower surface and are opposite to the first hold pads respectively. The space balls are disposed between the first and second hold pads, so that the first and second dielectric substrates are spaced by the space balls, whereby a clearance space is between the first and second dielectric substrates. At least one transmission line structure contacts the signal ball structure. The driven element is disposed on the lower surface and is electrically connected to the signal ball structure through the transmission line structure. The reflector is disposed on the first dielectric substrate and faces the driven element. The director is disposed on the upper surface of the second dielectric substrate.

In use, the driven element can radiate a radio wave. The reflector can reflect the radio wave to adjust an antenna radiation pattern. The director can enhance a directivity of the radio wave.

Many of the attendant features will be more readily appreciated, as the same becomes better understood by reference to the following detailed description considered in connection with the accompanying drawings.

BRIEF DESCRIPTION OF THE DRAWINGS

The present description will be better understood from the following detailed description read in light of the accompanying drawing, wherein.

DETAILED DESCRIPTION

Figure 1:
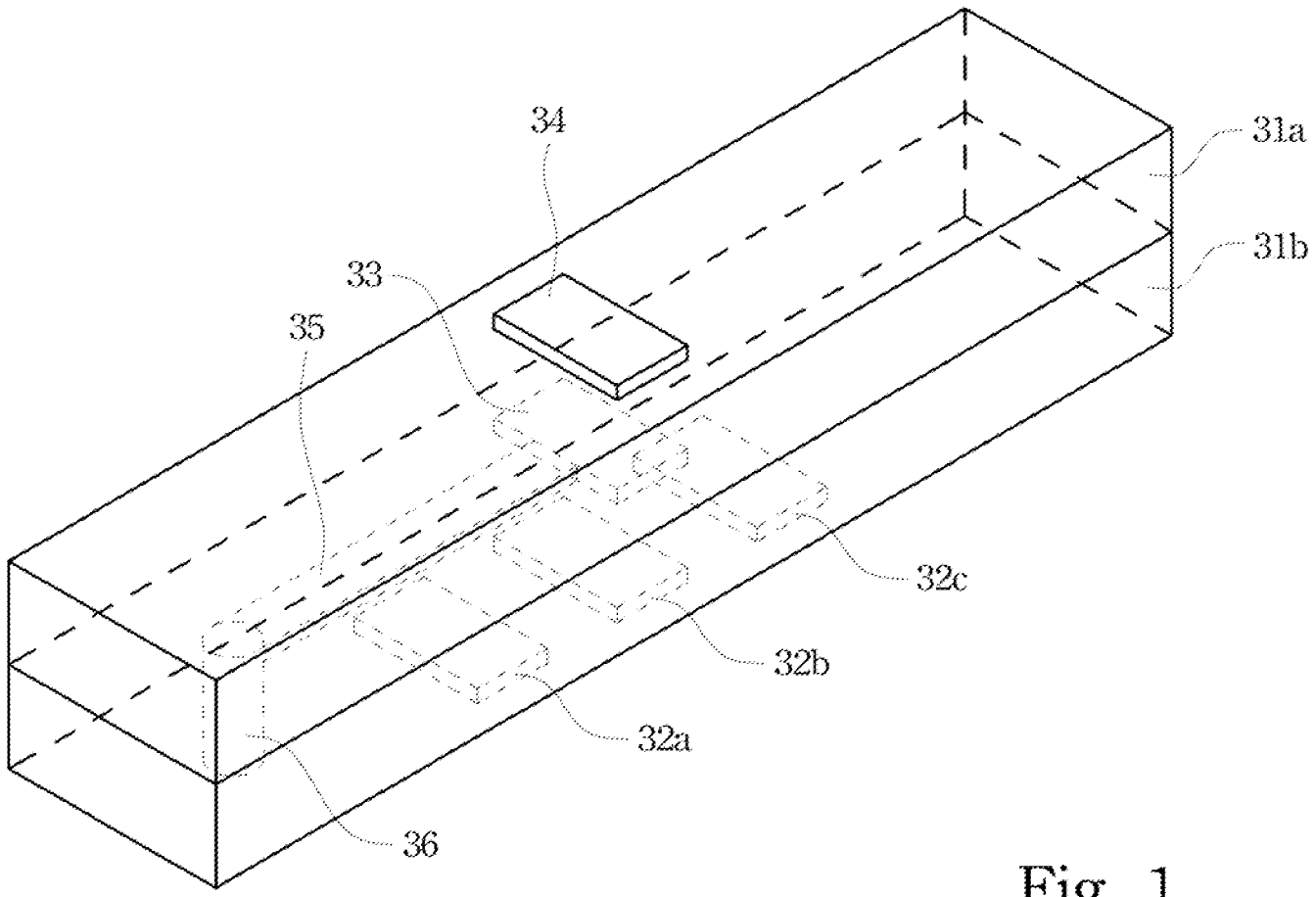
FIG. 1 is a perspective drawing of a stacked antenna according to the first embodiment of the present disclosure.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In one or more aspects, the present disclosure is directed to stacked antennas with high gain and broad bandwidth, and is also directed to methods of manufacturing the antennas. The antenna may be easily inserted into wireless communication products, and may be applicable or readily adaptable to all technology. Two kinds of stacked antennas are described as follows.

1. One or more conductive vias are formed in a first stacked antenna. In a manufacturing process, the conductive vias are formed through dielectric substrates respectively, metals are formed on the surfaces of the dielectric substrates, and then these substrate are stacked to constitute the first stacked antenna (show in FIGS. 1-5); and 2. Solder balls are implemented in a second stacked antenna. In a manufacturing process, metals are formed on the surfaces of dielectric substrates, the solder balls formed on the undersurface of the upper substrate, and then the solder balls are soldered on the metal of the lower substrate to constitute the second stacked antenna (show in FIGS. 8-10).

FIG. 1 is a perspective drawing of a stacked antenna according to first embodiment of the present disclosure. As shown in FIG. 1, the stacked antenna includes a first dielectric substrate 31*b*, a second dielectric substrate 31*a*, a conductive structure 36, a transmission line structure 35, a driven element 33, reflectors 32*a*, 32*b* and 32*c* and a director 34.

The second dielectric substrate 31*a* is stacked on the first dielectric substrate 31*b*. The conductive structure 36 penetrates the first dielectric substrate 31*b*. The transmission line structure 35 is disposed between the first and second dielectric substrates 31*b* and 31*a*. The driven element 33 is disposed between the first and second dielectric substrates 31*b* and 31*a* and is electrically connected to the conductive structure 36 through the transmission line structure 35. The reflectors 32*a*, 32*b* and 32*c* are spaced from the driven element 33 by the first dielectric substrate 31*b* and are disposed under the first dielectric substrate 31*b*. The director 34 is spaced from the driven element 33 by the second dielectric substrate 31*a*.

In use, the driven element 33 can radiate a radio wave. The reflectors 32*a*, 32*b* and 32*c* can reflect the radio wave to adjust an antenna radiation pattern. The director 34 can enhance a directivity of the radio wave.

In practice, the conductive structure penetrates the first or second dielectric substrate according as signals are fed to a lower or upper portion of the stacked antenna. In the first embodiment, the conductive structure 36 penetrates the first dielectric substrate 31*b*; in an alternative embodiment, the conductive structure 36 penetrates the second dielectric substrate 31*a* (not shown).

It should be noted that the director 34 is illustrated as a single one for illustrative purposes only; in practice, a plurality of directors may be utilized to further the directivity of the radiation pattern and radiation gain. Similarly, the reflectors 32*a*, 32*b* and 32*c* as three for illustrative purposes only; in practice, one or more reflectors may be utilized in the stacked antenna. More reflectors can further the directivity of the radiation pattern and radiation gain.

In practice, the driven element 33 is directly above the reflectors 32*a*, 32*b* and 32*c*, and the director 34 is directly above the driven element 33, so as to further functional support.

In the first embodiment, the length of the director 34 is 0.3-07 times as long as an effective wavelength of the radio wave. If the length of the director 34 was longer than 0.3-0.7 times as long as an effective wavelength of the radio wave, the antenna radiation pattern would likely be distorted. If the length of the director 34 was shorter than 0.3-0.7 times as long as the effective wavelength of the radio wave, the directivity of the radio wave would be affected adversely. The length of the driven element 33 is 0.3-0.7 times as long as the effective wavelength of the radio wave. If the length of the driven element 33 were not within this range, an additional compensation element would be added for frequency compensation; however, the performance of the stacked antenna would be affected adversely. Moreover, the length of each of the reflectors 32*a*, 32*b* and 32*c* is 0.3-0.7 times as long as the effective wavelength of the radio wave.

The length of the driven element 33 is longer than the length of the director 34 and is shorter than the length of each of the reflectors 32*a*, 32*b* and 32*c*, so as to emit the radio wave to the outside of the stacked antenna, where the radio wave is emitted along a direction from the reflectors 32*a*, 32*b* and 32*c* to the director 34. For example, the length of the director 34 is 0.44 times as long as the effective wavelength of the radio wave, the length of the driven element 33 is 0.46 times as long as the effective wavelength of the radio wave, and the length of each of the reflectors 32*a*, 32*b* and 32*c* is 0.48 times as long as the effective wavelength of the radio wave.

In the first embodiment, the method of manufacturing the stacked antenna includes steps as follows (The steps are not recited in the sequence in which the steps are performed. That is, unless the sequence of the steps is expressly indicated, the sequence of the steps is interchangeable, and all or part of the steps may be simultaneously, partially simultaneously, or sequentially performed). First, the conductive structure 36 is formed through the first dielectric substrate 31*b*. Second, the driven element 33 and the transmission line structure 35 are formed on the upper surface of first dielectric substrate 31*b*, and the reflectors 32*a*, 32*b* and 32*c* are formed on the lower surface of the first dielectric substrate 31*b*. Third, the director 34 is formed on the upper surface of the second dielectric substrate 31*a*. Fourth, The second dielectric substrate 31*a* is stacked on the first dielectric substrate 31*b* to constitute the first stacked antenna as shown in FIG. 1.

Figure 2:
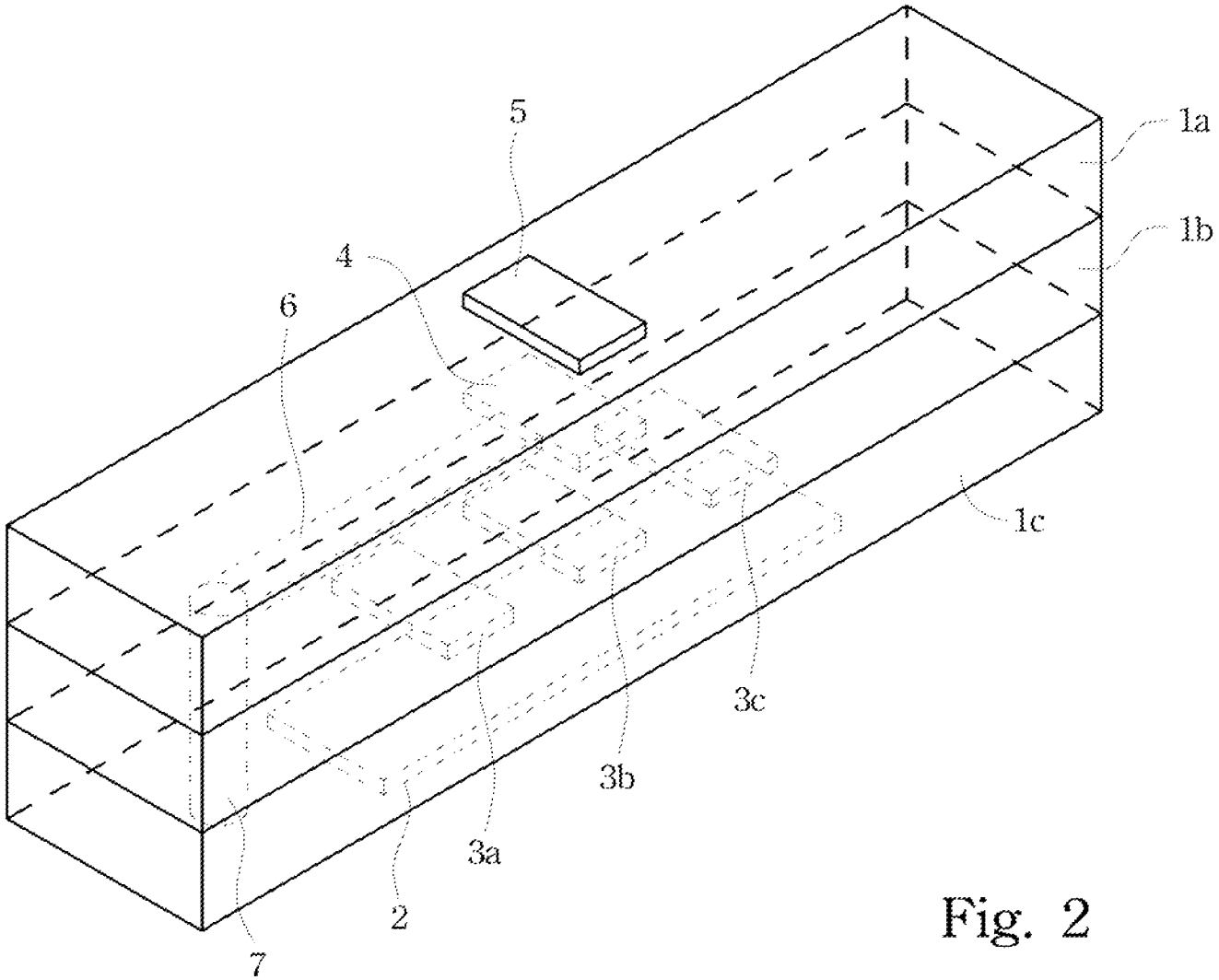
FIG. 2 is a perspective drawing of a stacked antenna according to the second embodiment of the present disclosure.

FIG. 2 is a perspective drawing of a stacked antenna according to second embodiment of the present disclosure. As shown in FIG. 2, the stacked antenna includes a first dielectric substrate 1*b*, a second dielectric substrate 1*a*, a third dielectric substrate 1*c*, a conductive structure 7, a transmission line structure 6, a driven element 4, reflectors 3*a*, 3*b* and 3*c*, a director 5 and a ground element 2.

The second dielectric substrate 1*a* is stacked on the first dielectric substrate 1*b*. The transmission line structure 6 is disposed between the first and second dielectric substrates 1*b* and 1*a*. The driven element 4 is disposed between the first and second dielectric substrates 1*b* and 1*a* and is electrically connected to the conductive structure 7 through the transmission line structure 6. The reflectors 3*a*, 3*b* and 3*c* are spaced from the driven element 4 by the first dielectric substrate 1*b* and are disposed under the first dielectric substrate 1*b*. The director 5 is spaced from the driven element 4 by the second dielectric substrate 1*a*. The first dielectric substrate 1*b* is stacked on the third dielectric substrate 1*c*, and the first dielectric substrate 1*b* is disposed between the second and third dielectric substrate 1*a* and 1*c*. The conductive structure 7 penetrates the first and third dielectric substrate 1*b* and 1*c*. The ground element 2 is spaced from the reflectors 3*a*, 3*b* and 3*c* by the third dielectric substrate 1*c* and is disposed under the third dielectric substrate 1*c*.

In use, signals are fed to the driven element 4 through the conductive structure 7 and the transmission line structure 6, and then the driven element 4 can radiate a radio wave. The reflectors 3*a*, 3*b* and 3*c* can reflect the radio wave to adjust an antenna radiation pattern. The director 5 can enhance a directivity of the radio wave. The driven element 4 is isolated from noise interference by means of the ground element 2.

It should be noted that the ground element 2 is illustrated as a flat cuboid for illustrative purposes only and is not meant to limit the present invention in any manner. In practice, the ground element 2 may be formed in any shape if it can shield the driven element 4 from noise under the stacked antenna. If there were no noise source under the stacked antenna, the ground element could be removed.

In practice, the conductive structure penetrates the second dielectric substrate or the first and third dielectric substrates according as signals are fed to an upper or lower portion of the stacked antenna. In the second embodiment, the conductive structure 7 penetrates the first and third dielectric substrates 1*b* and 1*c*; in an alternative embodiment, the conductive structure 7 penetrates the second dielectric substrate 1*a* (not shown).

In practice, the driven element 4 is directly above the reflectors 3*a*, 3*b* and 3*c*, and the director 5 is directly above the driven element 4, so as to further functional support.

In the second embodiment, the length of the director 5 is 0.3-0.7 times as long as an effective wavelength of the radio wave. If the length of the director 5 was longer than 0.3-0.7 times as long as an effective wavelength of the radio wave, the antenna radiation pattern would likely be distorted. If the length of the director 5 was shorter than 0.3-0.7 times as long as the effective wavelength of the radio wave, the directivity of the radio wave would be affected adversely. The length of the driven element 4 is 0.3-0.7 times as long as the effective wavelength of the radio wave. If the length of the driven element 4 were not within this range, an additional compensation element would be added for frequency compensation; however, the performance of the stacked antenna would be affected adversely. Moreover, the length of each of the reflectors 3*a*, 3*b* and 3*c* is 0.3-0.7 times as long as the effective wavelength of the radio wave.

The length of the driven element 4 is longer than the length of the director 5 and is shorter than the length of each of the reflectors 3*a*, 3*b* and 3*c*, so as to emit the radio wave to the outside of the stacked antenna, where the radio wave is emitted along a direction from the reflectors 3*a*, 3*h* and 3*c* to the director 5. For example, the length of the director 5 is 0.44 times as long as the effective wavelength of the radio wave, the length of the driven element 4 is 0.46 times as long as the effective wavelength of the radio wave, and the length of each of the reflectors 3*a*, 3*b* and 3*c* is 0.48 times as long as the effective wavelength of the radio wave.

In the second embodiment, the method of manufacturing the stacked antenna includes steps as follows (The steps are not recited in the sequence in which the steps are performed. That is, unless the sequence of the steps is expressly indicated, the sequence of the steps is interchangeable, and all or part of the steps may be simultaneously, partially simultaneously, or sequentially performed). First, the conductive structure 7 is formed through the first and third dielectric substrate 1*b* and 1*c*. Second, the reflectors 3*a*, 3*b* and 3*c* are formed on the upper surface of the third dielectric substrate 1*c*, and the ground element 2 is formed on the lower surface of the third dielectric substrate 1*c*. Third the driven element 4 and the transmission line structure 6 are formed on the upper surface of first dielectric substrate 1*b*. Fourth, the director 5 is formed on the upper surface of the second dielectric substrate 1*a*. Fourth, The first, second and third dielectric substrate 1*a*, 1*b* and 1*c* are stacked to constitute the stacked antenna as shown in FIG. 2.

Figure 3:
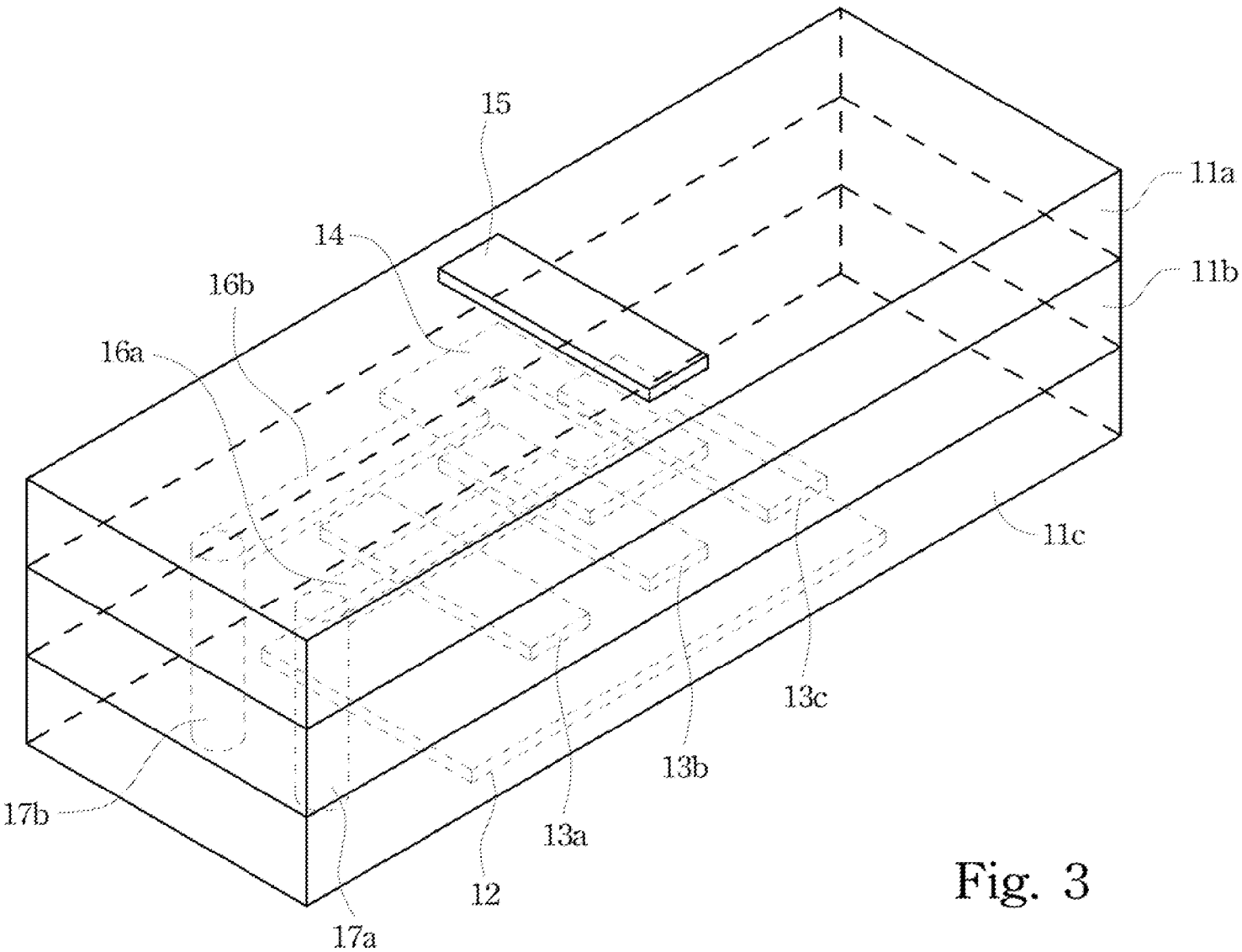
FIG. 3 is a perspective drawing of a stacked antenna according to the third embodiment of the present disclosure.

FIG. 3 is a perspective drawing of a stacked antenna according to third embodiment of the present disclosure. As shown in FIG. 3, the stacked antenna includes a first dielectric substrate 11*b*, a second dielectric substrate 11*a*, a third dielectric substrate 11*c*, conductive vias 17*a* and 17*b*, feed lines 16*a* and 16*b*, a driven element 14, reflectors 13*a*, 13*b* and 13*c*, a director 15 and a ground element 12. In the third embodiment, the driven element 14 is a differentially fed antenna element.

The second dielectric substrate 11*a* is stacked on the first dielectric substrate 11*b*. The feed lines 16*a* and 16*b* are disposed between the first and second dielectric substrates 11*b* and 11*a*. The driven element 14 is disposed between the first and second dielectric substrates 11*b* and 11*a*, and its two differential feeds are electrically connected to the conductive vias 17*a* and 17*b* through the feed lines 16*a* and 16*b*. The reflectors 13*a*, 13*b* and 13*c* are spaced from the driven element 14 by the first dielectric substrate 11*b* and are disposed under the first dielectric substrate 11*b*. The director 15 is spaced from the driven element 14 by the second dielectric substrate 11*a*. The first dielectric substrate 11*b* is stacked on the third dielectric substrate 11*c*, and the first dielectric substrate 11*b* is disposed between the second and third dielectric substrate 11*a* and 11*c*. The conductive vias 17*a* and 17*b* penetrate the first and third dielectric substrate 11*b* and 11*c*. The ground element 12 is spaced from the reflectors 13*a*, 13*b* and 13*c* by the third dielectric substrate 11*c* and is disposed under the third dielectric substrate 11*c*.

In use, signals are fed to the driven element 14 through the conductive vias 17*a* and 17*b* and the feed lines 16*a* and 16*b*, and then the driven element 14 can radiate a radio wave. The reflectors 13*a*, 13*b* and 13*c* can reflect the radio wave to adjust an antenna radiation pattern. The director 15 can enhance a directivity of the radio wave. The driven element 14 is isolated from noise interference by means of the ground element 12.

It should be noted that the ground element 12 is illustrated as a flat cuboid for illustrative purposes only and is not meant to limit the present invention in any manner. In practice, the ground element 12 may be formed in any shape if it can shield the driven element 14 from noise under the stacked antenna. If there were no noise source under the stacked antenna, the ground element could be removed.

In practice, the conductive structure penetrates the second dielectric substrate or the first and third dielectric substrates according as signals are fed from an upper or lower portion of the stacked antenna. In the third embodiment, the conductive vias 17*a* and 17*b* penetrate the first and third dielectric substrates 11*b* and 11*c*; in an alternative embodiment, the conductive vias 17*a* and 17*b* penetrate the second dielectric substrate 11*a* (not shown).

In practice, the driven element 14 is directly above the reflectors 13*a*, 13*b* and 13*c*, and the director 15 is directly above the driven element 14, so as to further functional support.

In the third embodiment, the length of the director 15 is 0.3-0.7 times as long as an effective wavelength of the radio wave. If the length of the director 15 was longer than 0.3-0.7 times as long as an effective wavelength of the radio wave, the antenna radiation pattern would likely be distorted. If the length of the director 15 was shorter than 0.3-0.7 times as long as the effective wavelength of the radio wave, the directivity of the radio wave would be affected adversely. The length of the driven element 14 is 0.3-0.7 times as long as the effective wavelength of the radio wave. If the length of the driven element 14 were not within this range, an additional compensation element would be added for frequency compensation; however, the performance of the stacked antenna would be affected adversely. Moreover, the length of each of the reflectors 13*a*, 13*b* and 13*c* is 0.3-0.7 times as long as the effective wavelength of the radio wave.

The length of the driven element 14 is longer than the length of the director 15 and is shorter than the length of each of the reflectors 13*a*, 13*b* and 13*c*, so as to emit the radio wave to the outside of the stacked antenna, where the radio wave is emitted along a direction from the reflectors 13*a*, 13*b* and 13*c* to the director 15. For example, the length of the director 15 is 0.44 times as long as the effective wavelength of the radio wave, the length of the driven element 14 is 0.46 times as long as the effective wavelength of the radio wave, and the length of each of the reflectors 13*a*, 13*b* and 13*c* is 0.48 times as long as the effective wavelength of the radio wave.

In the third embodiment, the method of manufacturing the stacked antenna includes steps as follows (The steps are not recited in the sequence in which the steps are performed. That is, unless the sequence of the steps is expressly indicated, the sequence of the steps is interchangeable, and all or part of the steps may be simultaneously, partially simultaneously, or sequentially performed). First, the conductive vias 17*a* and 17*b* are formed through the first and third dielectric substrate 11*b* and 11*c*. Second, the reflectors 13*a*, 13*b* and 13*c* are formed on the upper surface of the third dielectric substrate 11*c*, and the ground element 12 is formed on the lower surface of the third dielectric substrate 11*c*. Third, the driven element 14 and the feed lines 16*a* and 16*b* are formed on the upper surface of first dielectric substrate 11*b*. Fourth, the director 15 is formed on the upper surface of the second dielectric substrate 11*a*. Fifth, The first, second and third dielectric substrate 11*a*, 11*b* and 11*c* are stacked to constitute the stacked antenna as shown in FIG. 3.

Figure 4:
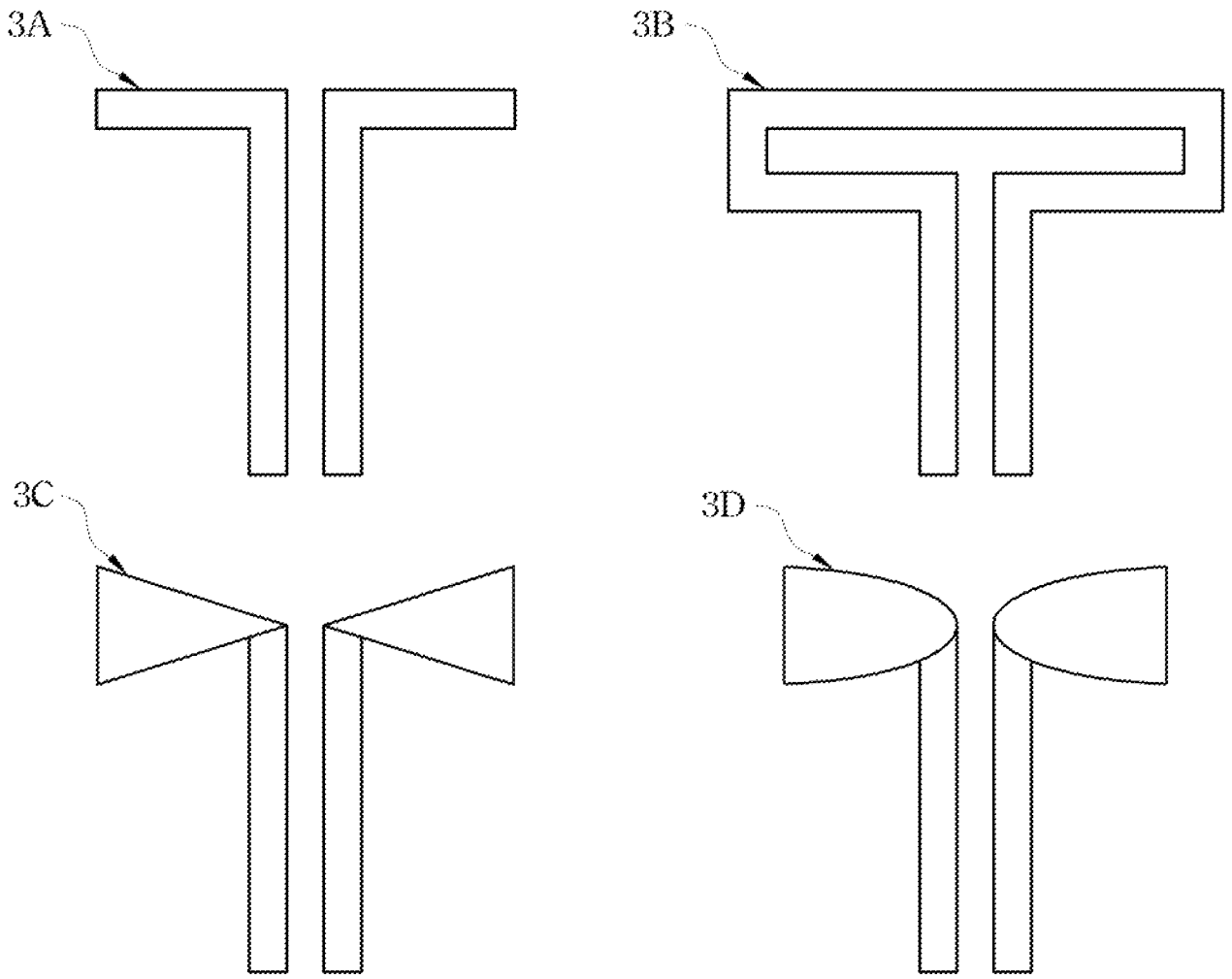
FIG. 4 shows various structures of the driven element of FIG. 3.

FIG. 4 shows various structures of the driven element of FIG. 3. In FIG. 3, the driven element 14 is an antenna element having two differential ends, the antenna element is a dipole antenna 3A, a folded dipole antenna 3B, a bow-tie dipole antenna 3C or an oval dipole antenna 3D. The dipole antenna 3A and/or the folded dipole antenna 3B may be used in a relatively narrowband of frequencies; the bow-tie dipole antenna 3C and/or the oval dipole antenna 3D may be used in a relatively broadband of frequencies.

Figure 5:
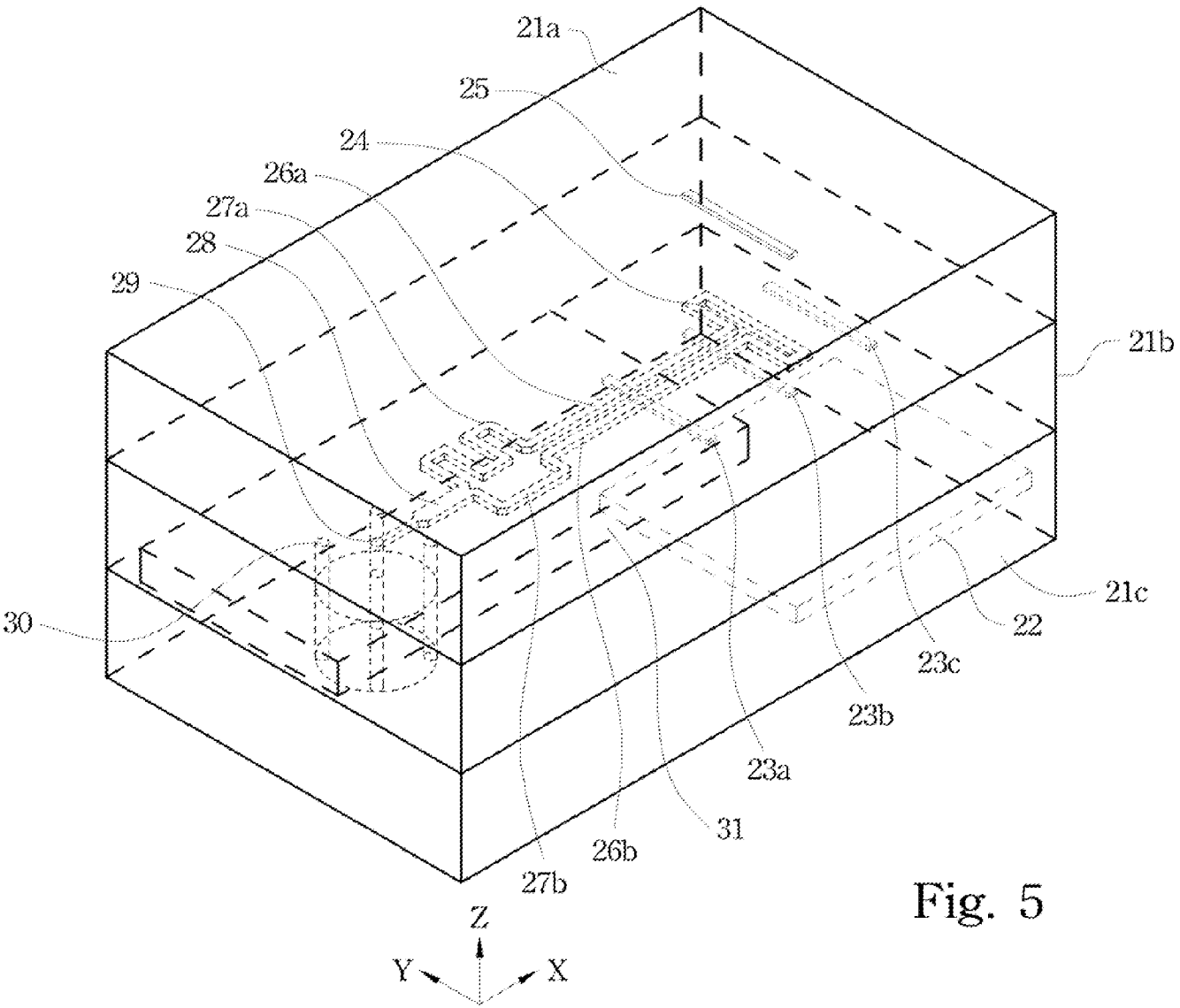
FIG. 5 is a perspective drawing of a stacked antenna according to the fourth embodiment of the present disclosure.

FIG. 5 is a perspective drawing of a stacked antenna according to fourth embodiment of the present disclosure. As shown in FIG. 5, the stacked antenna includes a first dielectric substrate 21*b*, a second dielectric substrate 21*a*, a third dielectric substrate 21*c*, conductive vias 29 and 30, a driven element 24, reflectors 23*a*, 23*b* and 23*c*, a director 25 and a ground element 22, a single-ended to differential converter (27*a* and 27*b*), a shielding box 31 and a transmission line structure. In the fourth embodiment, the transmission line structure is divided into a single transmission line structure 28 and two differential feed lines 26*a* and 26*b*, the conductive structure 29 functions as a signal via 29, the conductive vias 30 functions as grounding vias, and the driven element 24 is an antenna element having two differential ends.

The second dielectric substrate 21*a* stacked on the first dielectric substrate 21*b*. The transmission line structure (28, 26*a* and 26*b*) is disposed between the first and second dielectric substrates 21*b* and 21*a*. The driven element 24 is disposed between the first and second dielectric substrates 21*b* and 21*a*. The signal via 29 is connected to the single-ended to differential converter 27*a* and 27*b* through the single transmission line structure 28. The single-ended to differential converter 27*a* and 27*b* is connected to the driven element 24 through the two differential feed lines 26*a* and 26*b*. The reflectors 23*a*, 23*b* and 23*c* are spaced from the driven element 24 by the first dielectric substrate 21*b* and are disposed under the first dielectric substrate 21*b*. The director 25 is spaced from the driven element 24 by the second dielectric substrate 21*a*. The first dielectric substrate 21*b* is stacked on the third dielectric substrate 21*c* and the first dielectric substrate 21*b* is disposed between the second and third dielectric substrate 21*a* and 21*c*. The conductive structure 29 penetrates the first and third dielectric substrate 21*b* and 21*c*. The ground element 22 is spaced from the reflectors 23*a*, 23*b* and 23*c* by the third dielectric substrate 21*c* and is disposed under the third dielectric substrate 21*c*.

In use, signals are fed to the driven element 24 through the single transmission line structure 28, the single-ended to differential converter 27*a* and 27*b* and the differential feed lines 26*a* and 26*b*. Then the driven element 24 can radiate a radio wave. The reflectors 23*a*, 23*b* and 23*c* can reflect the radio wave to adjust an antenna radiation pattern. The director 25 can enhance a directivity of the radio wave. The driven element 24 is isolated from noise interference by means of the ground element 22. After two signals are transmitted through a wiring 27*a* and another wiring 27*b* of the single-ended to differential converter respectively, the phase difference of these two signals is 180°. Moreover, the single-ended to differential converter is used for an impedance match. For example, the single-ended to differential converter matches the single transmission line structure 28 (e.g. 50 ohm) with the differential feed lines 26*a* and 26*b* (e.g. 100 ohm). The shielding box 31 can shield the antenna radiation pattern from radiation of the single-ended to differential converter 27*a* and 27*b*. When the shielding box 31 is relatively close to the single-ended to differential converter 27*a* and 27*b*, the shielding effects is relatively enhanced.

It should be noted that the ground element 22 is illustrated as a flat cuboid for illustrative purposes only and is not meant to limit the present invention in any manner. In practice, the ground element 22 may be formed in any shape if it can shield the driven element 24 from noise under the stacked antenna. If there were no noise source under the stacked antenna, the ground element could be removed.

In practice, the conductive structure penetrates the second dielectric substrate or the first and third dielectric substrates according as signals are fed from an upper or lower portion of the stacked antenna. In the fourth embodiment, the conductive structure 29 penetrates the first and third dielectric substrates 21*b* and 21*c*; in an alternative embodiment, the conductive structure 29 penetrates the second dielectric substrate 21*a* (not shown).

In practice, the driven element 24 is directly above the reflectors 23*a*, 23*b* and 23*c*, and the director 25 is directly above the driven element 24, so as to further functional support.

In FIG. 5, the stacked antenna includes a plurality of grounding vias 30. The grounding vias 30 surround the signal via 29. In use, the grounding vias 30 can reduce signal transmission loss of the signal via 29. In high frequency applications, an electromagnetic signal leakage of the signal via 29 can be reduced by means of the grounding vias 30.

In the fourth embodiment, the length of the director 25 is 0.3-0.7 times as long as an effective wavelength of the radio wave. If the length of the director 25 was longer than 0.3-0.7 times as long as an effective wavelength of the radio wave, the antenna radiation pattern would likely be distorted. If the length of the director 25 was shorter than 0.3-0.7 times as long as the effective wavelength of the radio wave, the directivity of the radio wave would be affected adversely. The length of the driven element 24 is 0.3-0.7 times as long as the effective wavelength of the radio wave. If the length of the driven element 24 were not within this range, an additional compensation element would be added for frequency compensation; however, the performance of the stacked antenna would be affected adversely. Moreover, the length of each of the reflectors 23*a*, 23*b* and 23*c* is 0.3-0.7 times as long as the effective wavelength of the radio wave.

The length of the driven element 24 is longer than the length of the director 15 and is shorter than the length of each of the reflectors 23*a*, 23*b* and 230, so as to emit the radio wave to the outside of the stacked antenna, where the radio wave is emitted along a Z-axis from the reflectors 23*a*, 23*b* and 23*c* to the director 25. For example, the length of the director 25 is 0.44 times as long as the effective wavelength of the radio wave, the length of the driven element 24 is 0.46 times as long as the effective wavelength of the radio wave, and the length of each of the reflectors 23*a*, 23*b* and 23*c* is 0.48 times as long as the effective wavelength of the radio wave.

In the fourth embodiment, the method of manufacturing the stacked antenna includes steps as follows (The steps are not recited in the sequence in which the steps are performed. That is, unless the sequence of the steps is expressly indicated, the sequence of the steps is interchangeable, and all or part of the steps may be simultaneously, partially simultaneously, or sequentially performed). First, the signal via 29 and the grounding vias 30 are formed through the first and third dielectric substrate 21*b* and 21*c*. Second, the reflectors 23*a*, 23*b* and 23*c* are formed on the upper surface of the third dielectric substrate 21*c*, and the ground element 22 and the shielding box 31 are formed on the lower surface of the third dielectric substrate 21*c*. Third, the differential feed lines 26*a* and 26*b*, the driven element 24, the single transmission line structure 28 and the single-ended to differential converter 27*a* and 27*b* are formed on the upper surface of first dielectric substrate 21*b*. Fourth, the director 25 and another shielding box (not shown) are formed on the upper surface of the second dielectric substrate 21*a*. Fifth, the first, second and third dielectric substrates 21*a*, 21*b* and 21*c* are stacked to constitute the stacked antenna as shown in FIG. 5. Low temperature co-fired ceramic (LTCC) technology can be applied to make a multi-layer stacked antenna. In this way, the shielding box 31 is more close to the single-ended to differential converter 27*a* and 27*b*, so that the shielding effects can be enhanced.

Figure 6:
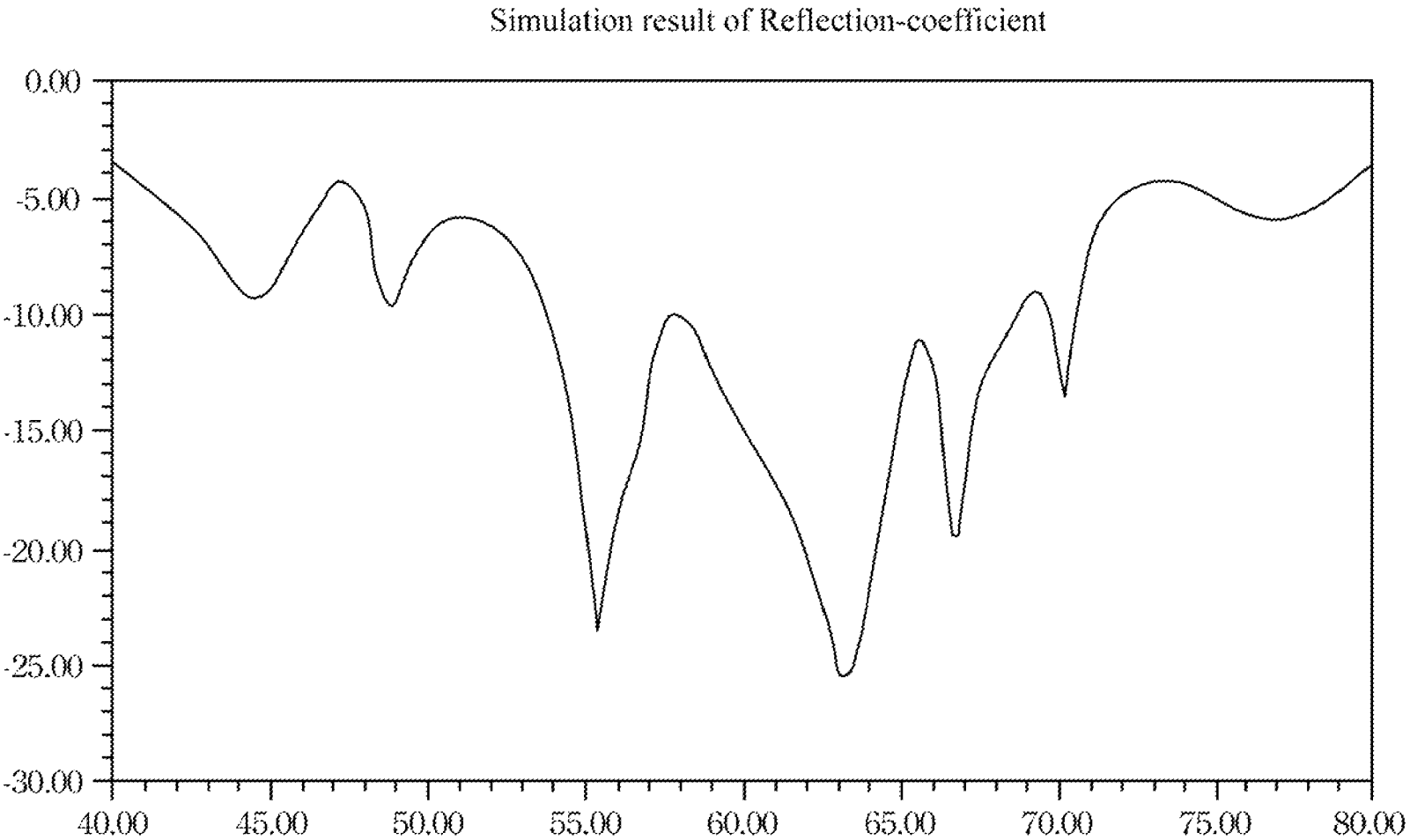
FIG. 6 is a reflection-coefficient chart of the stacked antenna according to the fourth embodiment of the present disclosure.
Figure 7:
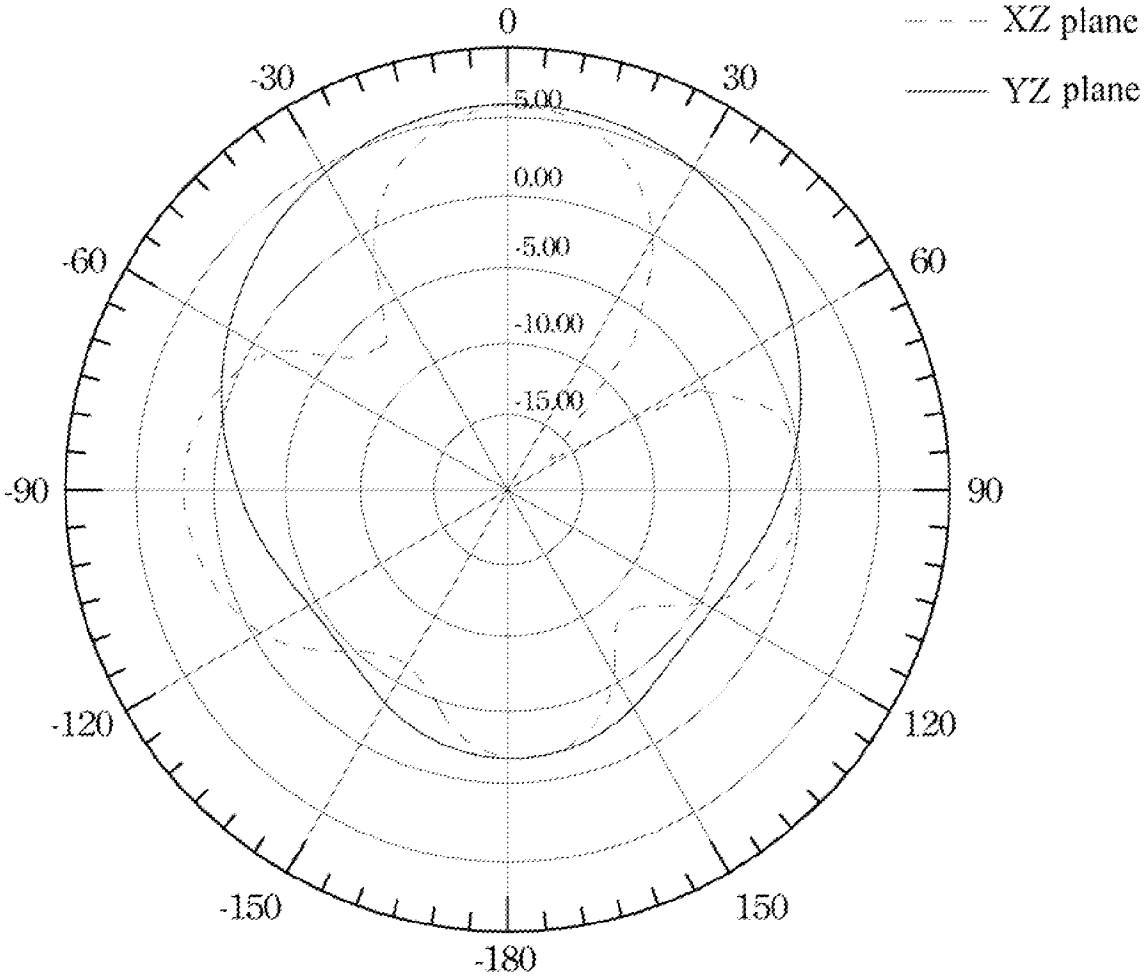
FIG. 7 shows a radiation pattern of the stacked antenna according to the fourth embodiment of the present disclosure.

FIG. 6 is a reflection-coefficient chart of the stacked antenna of FIG. 5 according to the fourth embodiment of the present disclosure. The stacked antenna can be used in 60 GHz band. Refer to FIG. 5, the first, second and third dielectric substrates 21*a*, 21*b* and 21*c* are formed by means of LTCC technology, wherein the permittivity of the dielectric substrates is about 7.8, and dielectric loss of the dielectric substrates is about 0.005. The thickness of the first dielectric substrate 21*a* is about 0.464 mm; the thickness of the second dielectric substrate 21*b* is about 0.418 mm; the thickness of the third dielectric substrate 21*c* is about 0.046 mm. In the stacked antenna, the thickness of metal is about 0.013 mm. The area of the ground element 22 is 2×2 mm. The length of each of the reflectors 23*a*, 23*b* and 23*c* is 0.48 times as long as the effective wavelength of the radio wave. In practice, the size of the reflectors can be trimmed for enhancing bandwidth. In this embodiment, the length of each of the reflectors 23*a*, 23*b* and 23*c* is 1.2 mm. The length of the director 25 is 0.44 times as long as the effective wavelength of the radio wave. In practice, the size of the director 25 can be trimmed for enhancing bandwidth. In this embodiment, the length of the director 25 is 0.6 mm. The length of the driven element 24 is 0.46 times as long as the effective wavelength of the radio wave. In practice, the size of the driven element 24 can be trimmed for enhancing bandwidth. In this embodiment, the length of the driven element 24 is 0.9 mm. Refer to FIG. 6, the reflection-coefficient chart shows an operating bandwidth of the stacked antenna is from 54 GHz to 68 GHz. FIG. 7 shows a radiation pattern of the stacked antenna according to the fourth embodiment of the present disclosure. Refer to FIG. 7, the maximum gain occurs in the Z-axis, and the gain value is 7 dBi.

Figure 8A:
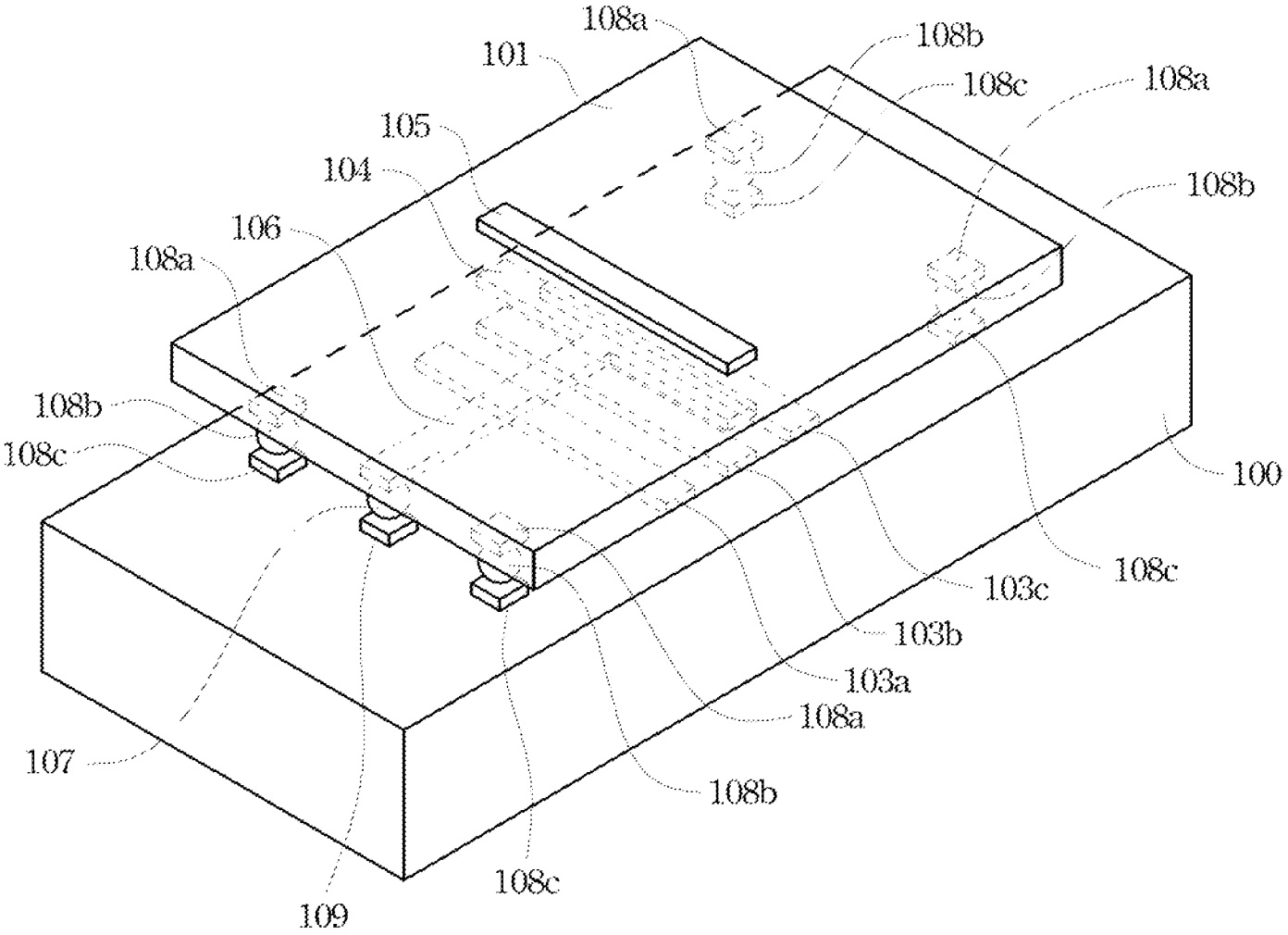
FIG. 8A is a perspective drawing of a stacked antenna according to the fifth embodiment of the present disclosure.
Figure 8B:
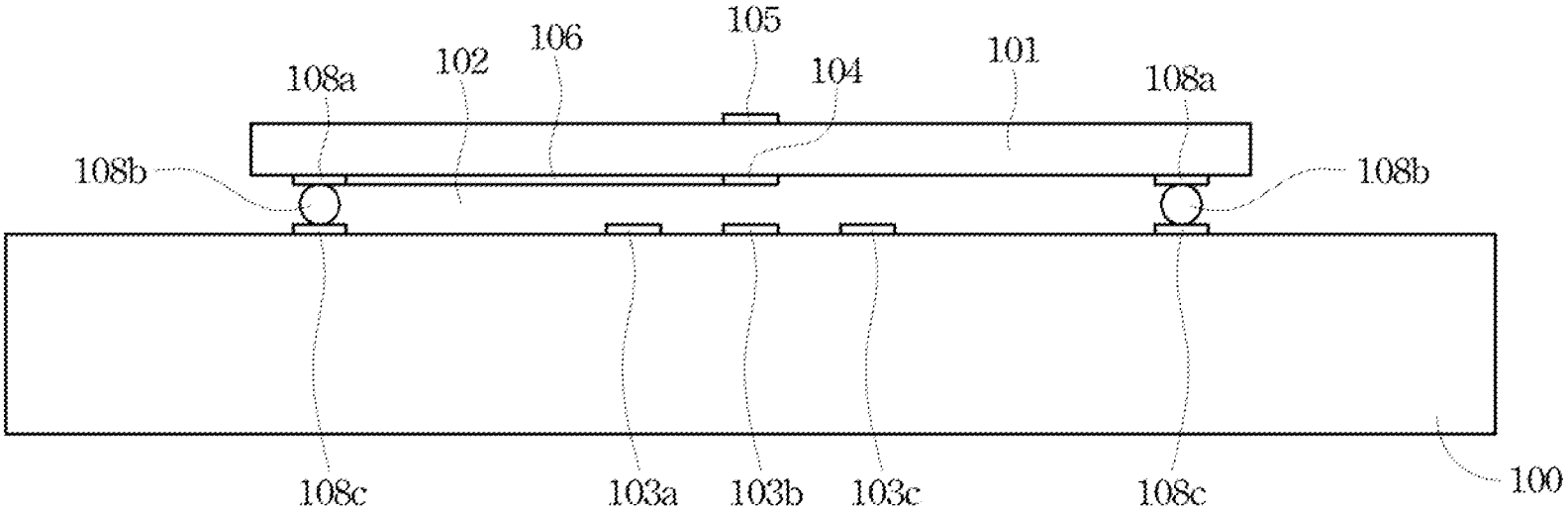
FIG. 8B is a cross-sectional vie of the stacked antenna according to the fifth embodiment of the present disclosure.

Refer to FIGS. 8A and 8B. FIGS. 8A and 8B are a perspective drawing and a cross-sectional view of a stacked antenna according to fifth embodiment of the present disclosure. The stacked antenna includes a first dielectric substrate 100, a second dielectric substrate 101, first hold pads 108*c*, a feed structure 109, a signal ball structure 107, second hold pads 108*a*, space balls 108*b*, a transmission line structure 106, a driven element 104, a director 105 and reflectors 103*a*, 103*b* and 103*c*.

The first hold pads 108*c* are disposed on the first dielectric substrate 100. The feed structure 109 is disposed on the first dielectric substrate. The signal ball structure 107 is disposed on the feed structure 109. The second dielectric substrate 101 has an upper surface and a lower surface, where the lower surface faces the first hold pads 108*c* and the feed structure 109. The second hold pads 108*a* are disposed on the lower surface of the second dielectric substrate 101 and are opposite to the first hold pads 108*c* respectively. The space balls 108*b* are disposed between the first and second hold pads 108*c* and 108*a* so that the first and second dielectric substrates 100 and 101 are spaced by the space balls 108*b*, whereby a clearance space 102 (e.g. an air layer) is between the first and second dielectric substrates 100 and 101. The transmission line structure 106 contacts the signal ball structure 107. The driven element 104 is disposed on the lower surface of the second dielectric substrate 101 and is electrically connected to the signal ball structure 107 through the transmission line structure 106. The reflectors 103*a*, 103*b* and 103*c* are disposed on the first dielectric substrate 100 and face the driven element 104. The director 105 is disposed on the upper surface of the second dielectric substrate 101.

In use, signals are fed to the driven element 104 through the signal ball structure 107 and the transmission line structure 106, and then the driven element 104 can radiate a radio wave. The reflectors 103*a*, 103*b* and 103*c* can reflect the radio wave to adjust an antenna radiation pattern. The director 105 can enhance a directivity of the radio wave.

The first and second hold pads 108*c* and 108*a* serve as soldering points for the space balls 108*b*, and the combination of the space balls 108*b* and the first and second hold pads 108*c* and 108*a* can support and fix the dielectric substrates. The size of the signal ball structure 107 may be substantially equal to the size of the space balls 108*b*. If solder balls have different size, the matching performance of the stacked antenna will be affected. For solving this problem, the length of the reflector 103*a*, 103*b* and 103*c* can be trimmed for impedance compensation.

It should be noted that the director 105 is illustrated as a single one for illustrative purposes only; in practice, a plurality of directors may be utilized to further the directivity of the radiation pattern and radiation gain. Similarly, the reflectors 103*a*, 103*b* and 103*c* as three for illustrative purposes only; in practice, one or more reflectors may be utilized in the stacked antenna. More reflectors can further the directivity of the radiation pattern and radiation gain.

In the fifth embodiment, the driven element 104 is directly above the reflectors 103*a*, 103*b* and 103*c*, and the director 105 is directly above the driven element 104, so as to further functional support.

In the fifth embodiment, the length of the director 105 is 0.3-0.7 times as long as an effective wavelength of the radio wave. If the length of the director 105 was longer than 0.3-0.7 times as long as an effective wavelength of the radio wave, the antenna radiation pattern would likely be distorted. If the length of the director 105 was shorter than 0.3-0.7 times as long as the effective wavelength of the radio wave, the directivity of the radio wave would be affected adversely. The length of the driven element 104 is 0.3-0.7 times as long as the effective wavelength of the radio wave. If the length of the driven element 104 were not within this range, an additional compensation element would be added for frequency compensation; however, the performance of the stacked antenna would be affected adversely. Moreover, the length of each of the reflectors 103*a*, 103*b* and 103*c* is 0.3-0.7 times as long as the effective wavelength of the radio wave.

The length of the driven element 104 is longer than the length of the director 105 and is shorter than the length of each of the reflectors 103*a*, 103*b* and 103*c*, so as to emit the radio wave to the outside of the stacked antenna, where the radio wave is emitted from the reflectors 103*a*, 103*b* and 103*c* to the director 105. For example, the length of the director 105 is 0.44 times as long as the effective wavelength of the radio wave, the length of the driven element 104 is 0.46 times as long as the effective wavelength of the radio wave, and the length of each of the reflectors 103*a*, 103*b* and 103*c* is 0.48 times as long as the effective wavelength of the radio wave.

In the fifth embodiment, the method of manufacturing the stacked antenna includes steps as follows (The steps are not recited in the sequence in which the steps are performed. That is, unless the sequence of the steps is expressly indicated, the sequence of the steps is interchangeable, and all or part of the steps may be simultaneously, partially simultaneously, or sequentially performed). First, the director 105 is formed on the upper surface of the second dielectric substrate 101, and the driven element 104, the transmission line structure 106 and the second hold pads 108*a* are formed on the lower surface of the second dielectric substrate 101. Second, the reflectors 103*a*, 103*b* and 103*c*, the feed structure 109 and the first hold pads 108*c* are formed on the upper surface of the first dielectric substrate 100. Third, the signal ball structure 107 are soldered on the transmission line structure 106, and the space balls 108*b* are soldered on the second hold pads 108*a*. Fourth, the signal ball structure 107 is aligned at the feed structure 109 on the first dielectric substrate 100, and the space balls 108*b* are aligned at the first hold pads 108*c* on the first dielectric substrate 100. Fifth, the second dielectric substrate 101 and the first dielectric substrate 100 are stacked to constitute the stacked antenna as shown in FIG. 8A.

Figure 9A:
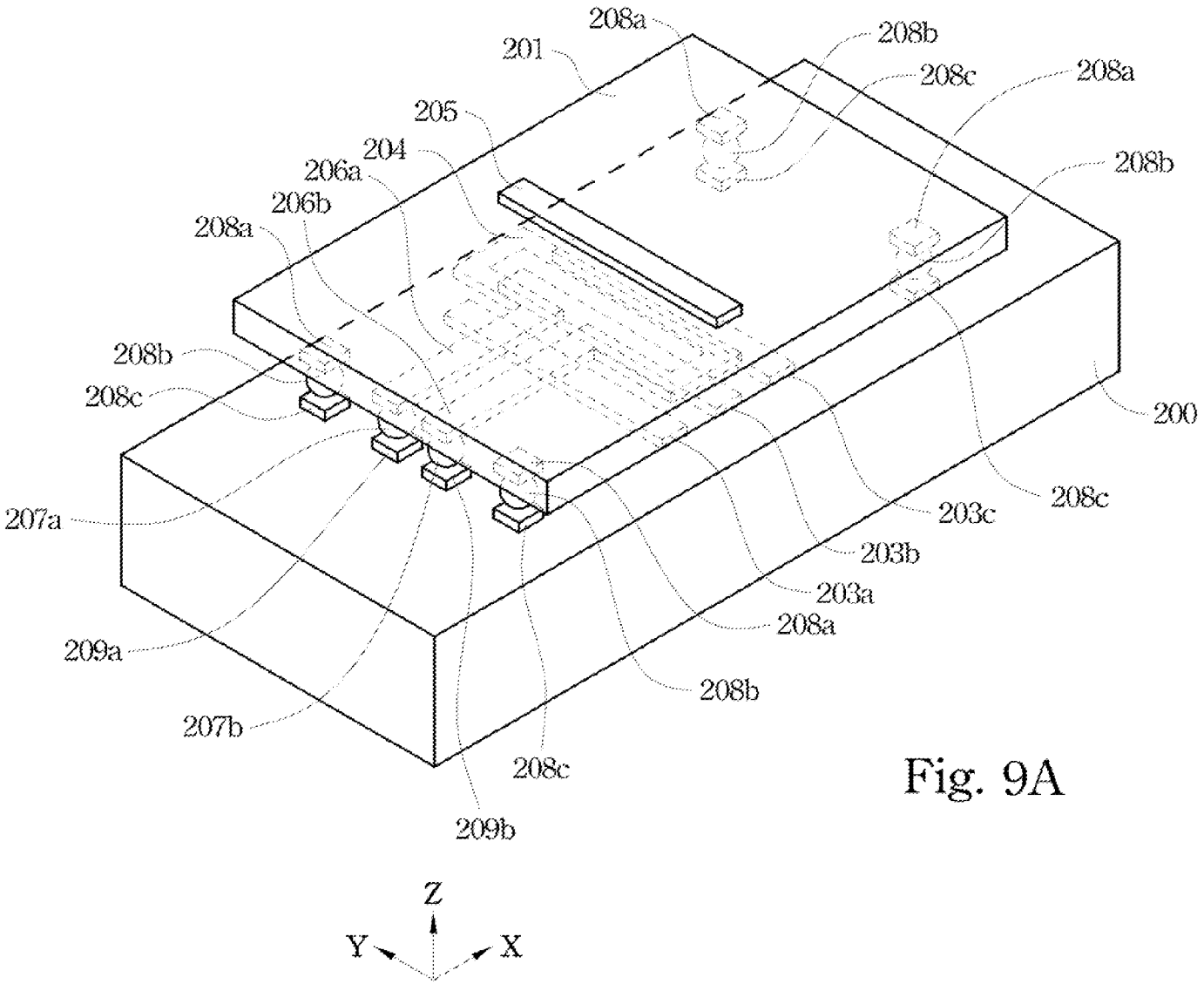
FIG. 9A is a perspective drawing of a stacked antenna according to the sixth embodiment of the present disclosure.
Figure 9B:
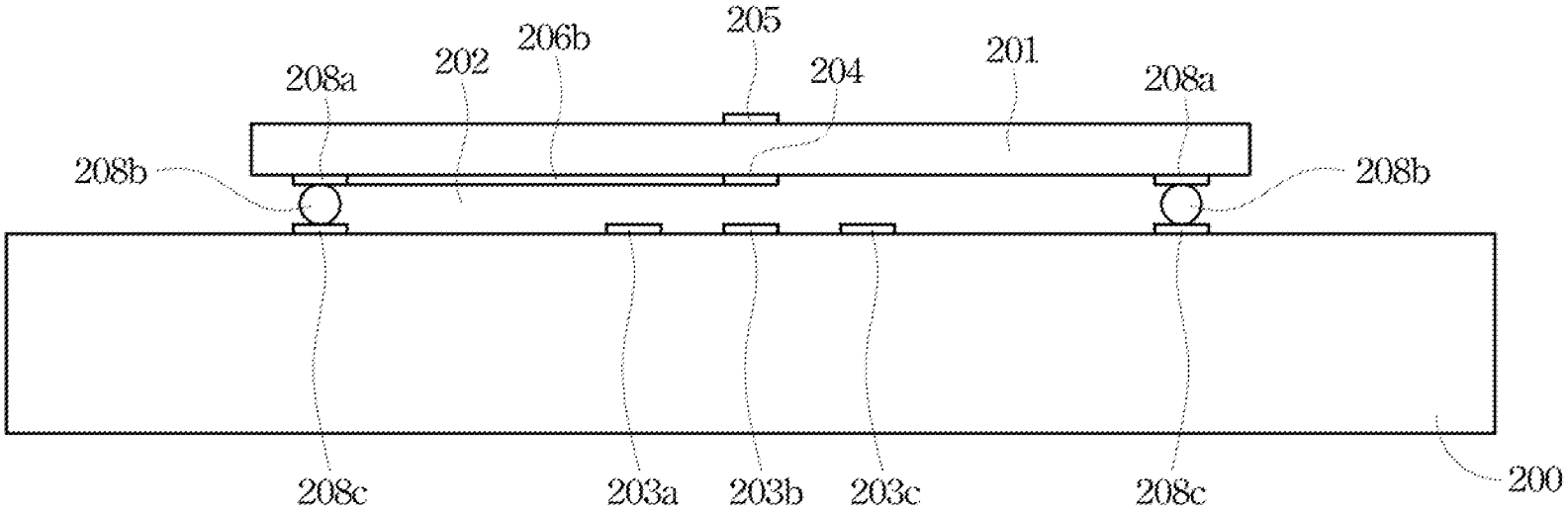
FIG. 9B is a cross-sectional view of the stacked antenna according to the sixth embodiment of the present disclosure.

Refer to FIGS. 9A and 9B. FIGS. 9A and 9B are a perspective drawing and a cross-sectional view of a stacked antenna according to the sixth embodiment of the present disclosure. The stacked antenna includes a first dielectric substrate 200, a second dielectric substrate 201, a first hold pads 208*c*, feed points 209*a* and 209*b*, signal balls 207*a* and 207*b*, a second hold pads 208*a*, space balls 208*b*, feed lines 206*a* and 206*b*, a driven element 204, a director 205 and reflectors 203*a*, 203*b* and 203*c*. In the sixth embodiment, the driven element 204 is a differentially fed antenna element.

The first hold pads 208*c* are disposed on the first dielectric substrate 200. The feed points 209*a* and 209*b* are disposed on the first dielectric substrate 200. The signal balls 207*a* and 207*b* are disposed on the feed points 209*a* and 209*b* respectively. The second dielectric substrate 201 has an upper surface and a lower surface, where the lower surface faces the first hold pads 208*c* and the feed points 209*a* and 209*b*. The second hold pads 208*a* are disposed on the lower surface of the second dielectric substrate 201 and are opposite to the first hold pads 208*c* respectively. The space balls 208*b* are disposed between the first and second hold pads 208*c* and 208*a*, so that the first and second dielectric substrates 200 and 201 are spaced by the space balls 208*b*, whereby a clearance space 202 (e.g. an air layer) is between the first and second dielectric substrates 200 and 201. The feed lines 206*a* and 206*b* contact the signal balls 207*a* and 207*b* respectively. The driven element 204 is disposed on the lower surface of the second dielectric substrate 201, and its two differential ends are electrically connected to the signal balls 207*a* and 207*b* through the feed lines 206*a* and 206*b*. The reflector reflectors 203*a*, 203*b* and 203*c* are disposed on the first dielectric substrate 100 and face the driven element 204 and are surrounded by the first hold pads 208*c*. The director 205 is disposed on the upper surface of the second dielectric substrate 201.

In use, signals are fed to the driven element 204 through the signal balls 207*a* and 207*b* and the feed lines 206*a* and 206*b*, then the driven element 204 can radiate a radio wave. The reflectors 203*a*, 203*b* and 203*c* can reflect the radio wave to adjust an antenna radiation pattern. The director 205 can enhance a directivity of the radio wave.

The first and second hold pads 208*c* and 208*a* serve as soldering points for the space balls 208*b*, and the combination of the space balls 208*b* and the first and second hold pads 208*c* and 208*a* can support and fix the dielectric substrates. The size of each of the signal balls 207*a* and 207*b* may be substantially equal to the size of each of the space balls 208*b*. If solder balls have different size, the matching performance of the stacked antenna will be affected. For solving this problem, the length of the reflector 203*a*, 203*b* and 203*c* can be trimmed for impedance compensation.

It should be noted that the director 205 is illustrated as a single one for illustrative purposes only; in practice, a plurality of directors may be utilized to further the directivity of the radiation pattern and radiation gain. Similarly, the reflectors 203*a*, 203*b* and 203*c* as three for illustrative purposes only; in practice, one or more reflectors may be utilized in the stacked antenna. More reflectors can further the directivity of the radiation pattern and radiation gain.

In the sixth embodiment, the driven element 204 is directly above the reflectors 203*a*, 203*b* and 203*c*, and the director 205 is directly above the driven element 204, so as to further functional support.

In the sixth embodiment, the length of the director 205 is 0.3-0.7 times as long as an effective wavelength of the radio wave. If the length of the director 205 was longer than 0.3-0.7 times as long as an effective wavelength of the radio wave, the antenna radiation pattern would likely be distorted. If the length of the director 205 was shorter than 0.3-0.7 times as long as the effective wavelength of the radio wave, the directivity of the radio wave would be affected adversely. The length of the driven element 204 is 0.3-0.7 times as long as the effective wavelength of the radio wave. If the length of the driven element 204 were not within this range, an additional compensation element would be added for frequency compensation; however, the performance of the stacked antenna would be affected adversely. Moreover, the length of each of the reflectors 203*a*, 203*b* and 203*c* is 0.3-0.7 times as long as the effective wavelength of the radio wave.

The length of the driven element 204 is longer than the length of the director 205 and is shorter than the length of each of the reflectors 203*a*, 203*b* and 203*c*, so as to emit the radio wave to the outside of the stacked antenna, where the radio wave is emitted along a Z-axis (from the reflectors 203*a*, 203*b* and 203*c* to the director 205). For example, the length of the director 205 is 0.44 times as long as the effective wavelength of the radio wave, the length of the driven element 204 is 0.46 times as long as the effective wavelength of the radio wave, and the length of each of the reflectors 203*a*, 203*b* and 203*c* is 0.48 times as long as the effective wavelength of the radio wave.

In the sixth embodiment, the method of manufacturing the stacked antenna includes steps as follows (The steps are not recited in the sequence in which the steps are performed. That is, unless the sequence of the steps is expressly indicated, the sequence of the steps is interchangeable, and all or part of the steps may be simultaneously, partially simultaneously, or sequentially performed). First, the director 205 is formed on the upper surface of the second dielectric substrate 201, and the driven element 204, the feed lines 206*a* and 206*b* and the second hold pads 208*a* are formed on the lower surface of the second dielectric substrate 201. Second, the reflectors 203*a*, 203*b* and 203*c*, the feed points 209*a* and 209*b* and the first hold pads 208*c* are formed on the upper surface of the first dielectric substrate 200. Third, the signal balls 207*a* and 207*b* are soldered on the feed lines 206*a* and 206*b*, and the space balls 208*b* are soldered on the second hold pads 208*a*. Fourth, the signal balls 207*a* and 207*b* are aligned at the feed points 209*a* and 209*b* on the first dielectric substrate 200, and the space balls 208*b* are aligned at the first hold pads 208*c* on the first dielectric substrate 200. Fifth, the second dielectric substrate 201 and the first dielectric substrate 200 are stacked to constitute the stacked antenna as shown in FIG. 9A.

Figure 10:
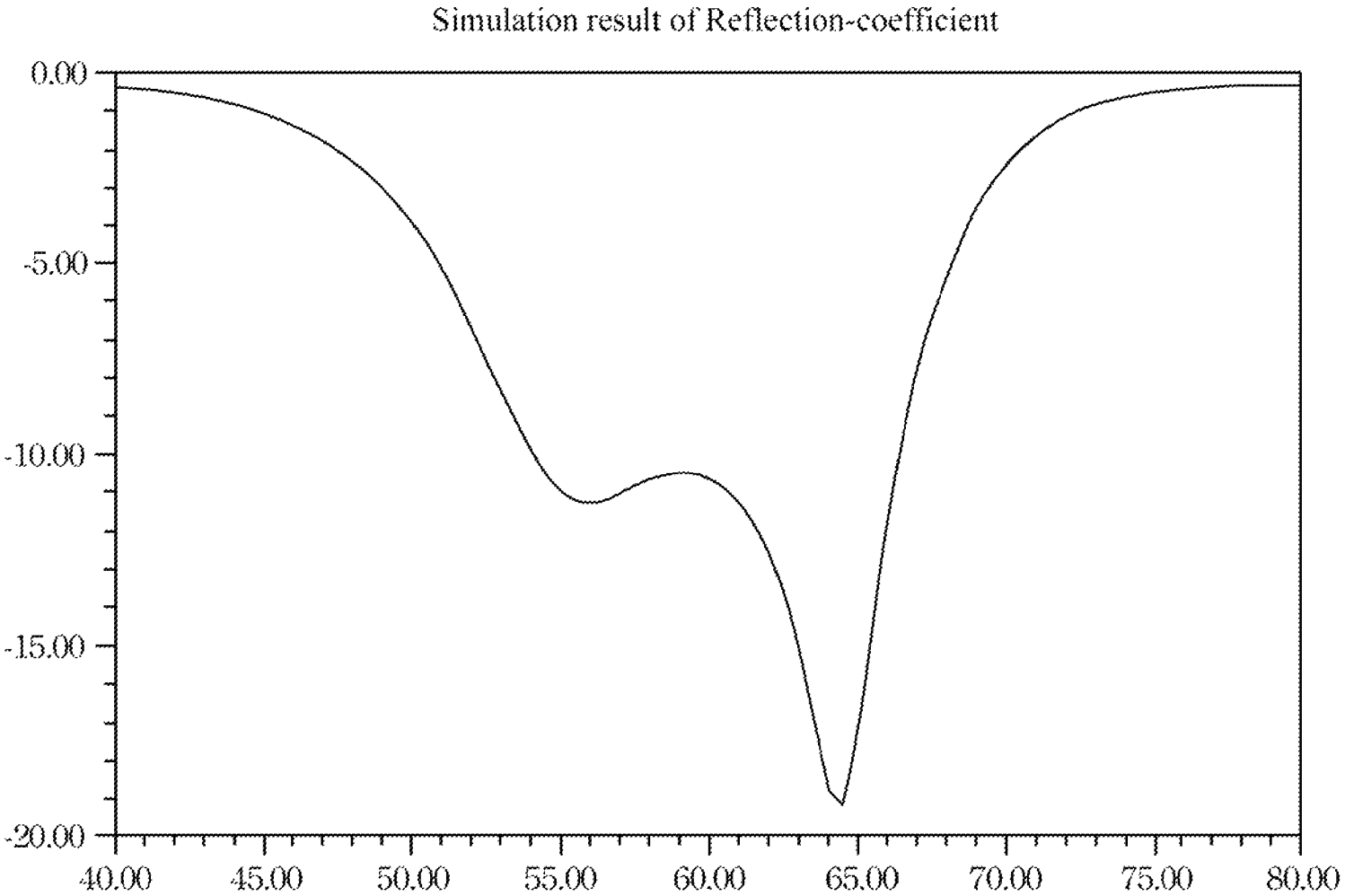
FIG. 10 is a reflection-coefficient chart of the stacked antenna according to the sixth embodiment of the present disclosure.
Figure 11:
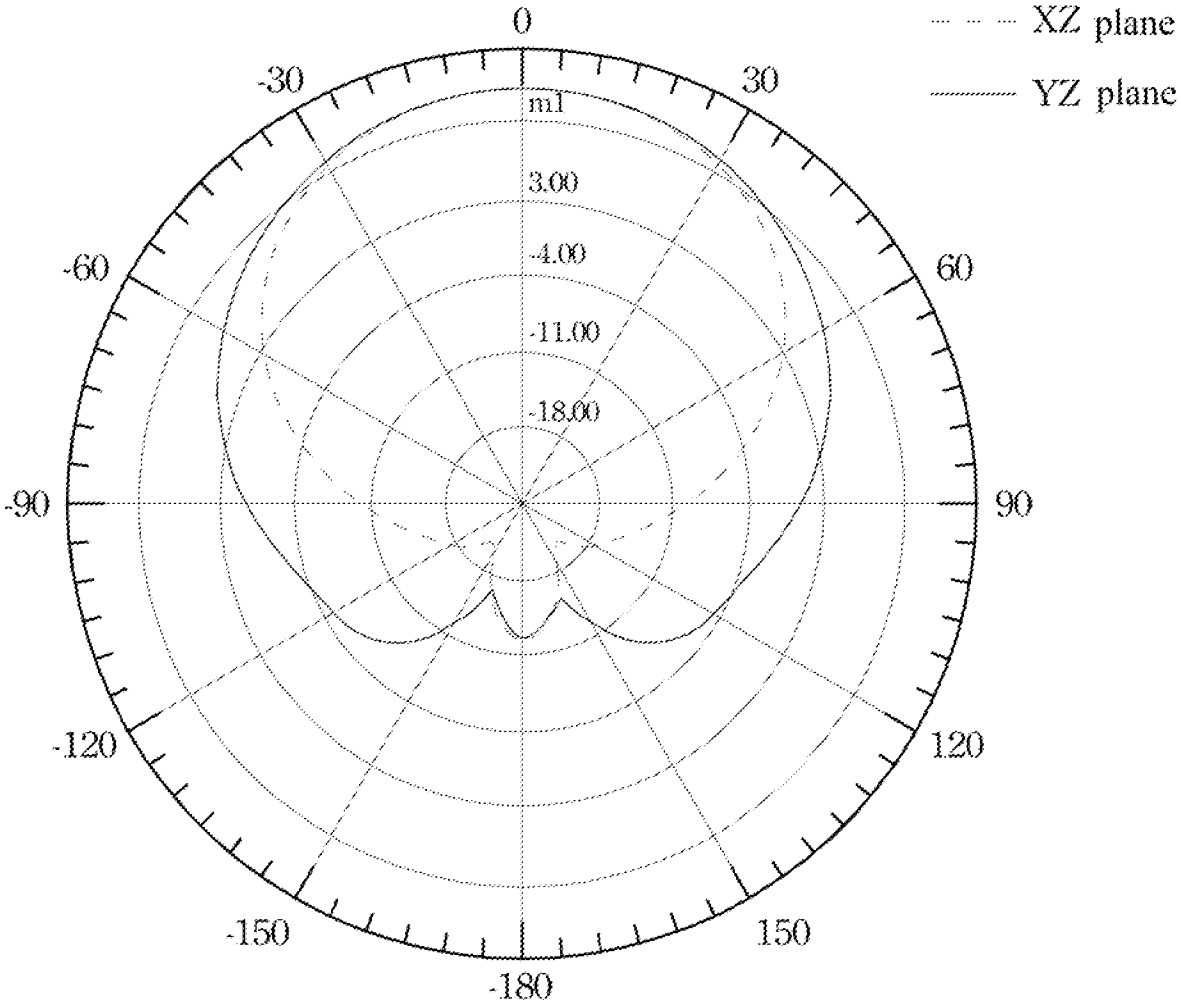
FIG. 11 shows a radiation pattern of the stacked antenna according to the sixth embodiment of the present disclosure.

FIG. 10 is a reflection-coefficient chart of the stacked antenna of FIG. 9A according to the sixth embodiment of the present disclosure. The stacked antenna can be used in 60 GHz band. Refer to FIG. 9A, the first dielectric substrate 200 is a FR-4 substrate, wherein the permittivity of the FR-4 substrate is about 4.4, and dielectric loss of the FR-4 substrate is about 0.02. The thickness of the FR-4 substrate is about 1 mm. The second dielectric substrate 201 is a glass substrate, wherein the permittivity of the glass substrate is about 5.2, and dielectric loss of the glass substrate is about 0.003. The thickness of the glass substrate is about 0.2 mm. In the stacked antenna, the thickness of metal is about 0.017 mm. The length of each of the reflectors 203*a*, 203*b* and 203*c* is 0.48 times as long as the effective wavelength of the radio wave. In practice, the size of the reflectors can be trimmed for enhancing bandwidth. In this embodiment, the length of each of the reflectors 203*a*, 203*b* and 203*c* is 1.8 mm. The length of the director 205 is 0.44 times as long as the effective wavelength of the radio wave. In practice, the size of the director 205 can be trimmed for enhancing bandwidth. In this embodiment, the length of the director 205 is 1.05 mm. The length of the driven element 204 is 0.46 times as long as the effective wavelength of the radio wave. In practice, the size of the driven element 204 can be trimmed for enhancing bandwidth. In this embodiment, the length of the driven element 24 is 1.7 mm. Refer to FIG. 10, the reflection-coefficient chart shows an operating bandwidth of the stacked antenna is from 54 GHz to 66.5 GHz. FIG. 11 shows a radiation pattern of the stacked antenna according to the sixth embodiment of the present disclosure. Refer to FIG. 11, the maximum gain occurs in the Z-axis, and the gain value is 7.18 dBi. The preferred gain value is achieved because of the glass substrate with low dielectric loss and the air layer between the substrates.

In above one or more embodiments, the dielectric substrates are made of dielectric material. For example, the dielectric material may be ceramic material, glass material, polymeric material or the like. The material of the reflectors, the driven element and the director may be metal. The feed lines and the conductive vias have metal material. The above solder balls may be metal balls.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims herein is not intended to invoke the provisions of 35 U.S.C. §112, 6th paragraph.

What is claimed is:

1. A stacked antenna, comprising:

a first dielectric substrate;

a plurality of first hold pads disposed on the first dielectric substrate;

at least one feed structure disposed on the first dielectric substrate;

at least one signal ball structure disposed on the feed structure;

a second dielectric substrate has an upper surface and a lower surface, the lower surface faces the first hold pads and the feed structure;

a plurality of second hold pads disposed on the lower surface and opposite to the first hold pads respectively;

a plurality of space balls disposed between the first and second hold pads, so that the first and second dielectric substrates are spaced by the space balls, whereby a clearance space is between the first and second dielectric substrates;

at least one transmission line structure contacting the signal ball structure;

a driven element disposed on the lower surface and electrically connected to the signal ball structure through the transmission line structure, for radiating the radio wave;

at least one reflector disposed on the first dielectric substrate and facing the driven element for reflecting the radio wave to adjust the antenna radiation pattern; and a director disposed on the upper surface for enhancing a directivity of the radio wave.

2. The stacked antenna of claim 1, wherein the driven element is an antenna element having two differential ends, said at least one feed structure includes two feed points, said at least one signal ball structure includes two signal balls, said at least one transmission line structure includes two feed lines, the two differential ends of the antenna element are electrically connected to the two signal balls through the two feed lines.

3. The stacked antenna of claim 2, wherein the antenna element is a dipole antenna, a folded dipole antenna, a bow-tie dipole antenna or an oval dipole antenna.

4. The stacked antenna of claim 1, wherein a length of the driven element is longer than a length of the director and is shorter than a length of the reflector.

5. The stacked antenna of claim 4, wherein the length of the driven element is 0.3-0.7 times as long as an effective wavelength of the radio wave.

6. The stacked antenna of claim 1, wherein the driven element is directly above the reflector, the director is directly above the driven element.

* * * * *